US009810440B2

(12) United States Patent
Kwon

(10) Patent No.: US 9,810,440 B2
(45) Date of Patent: Nov. 7, 2017

(54) VENTILATION SYSTEM FOR BATHROOM

(71) Applicant: Woo Deuk Kwon, Daegu (KR)
(72) Inventor: Woo Deuk Kwon, Daegu (KR)

( * ) Notice: Subject to any disclaimer, the term of this patent is extended or adjusted under 35 U.S.C. 154(b) by 0 days.

(21) Appl. No.: 14/397,205
(22) PCT Filed: Mar. 14, 2014
(86) PCT No.: PCT/KR2014/002181
§ 371 (c)(1),
(2) Date: Oct. 27, 2014
(87) PCT Pub. No.: WO2015/008919
PCT Pub. Date: Jan. 22, 2015

(65) Prior Publication Data

US 2016/0146484 A1 May 26, 2016

(30) Foreign Application Priority Data

Jul. 6, 2013 (KR) ..... 10-2013-0083329

(51) Int. Cl.
*F24F 7/06* (2006.01)
*F24F 11/00* (2006.01)
(Continued)

(52) U.S. Cl.
CPC ..... *F24F 7/08* (2013.01); *E03D 9/05* (2013.01); *F24F 7/10* (2013.01); *F24F 13/10* (2013.01); *F24F 2221/18* (2013.01)

(58) Field of Classification Search
CPC ..... F24F 7/08; F24F 7/10; E03D 9/05
(Continued)

(56) References Cited

U.S. PATENT DOCUMENTS 3,103,869 A * 9/1963 Dry ..... F24F 13/062 454/302
4,043,257 A * 8/1977 Aaberg ..... B08B 15/02 454/188
(Continued)

FOREIGN PATENT DOCUMENTS

CH 682512 A5 * 9/1993 ..... F24C 15/2028
JP 06-193937 7/1994
(Continued)

OTHER PUBLICATIONS

English Translatin of the Abstract of the CH 682512A5.*
(Continued)

*Primary Examiner* — Helena Kosanovic
(74) *Attorney, Agent, or Firm* — Antonio Ha & U.S. Patent, LLC

(57) ABSTRACT

The present invention aims to provide a bathroom ventilation system having a bi-directional ventilation tube that exhausts internal air to the outside while supplying external air into the bathroom to allow for quick ventilation in the bathroom and to draw toilet odors as well as air in the bathroom out of the bathroom through an internal air traveling tube, thereby minimizing occurrence of odors.

To achieve the above object, according to the present invention, a ventilation system for a bathroom comprises: an external air traveling tube 100 provided at an upper side of a ceiling panel of the bathroom and having an air intake fan 150 that takes air in from an outside and moves the taken-in air to an inside of the bathroom; an internal air traveling tube 200 provided at the upper side of the ceiling panel of the bathroom and having an air exhausting fan 250 that draws air from the inside of the bathroom to the outside; and a bi-directional ventilation tube 300 provided at a ceiling of the bathroom, the bi-directional ventilation tube 300 including an air exhausting part 310 having a side connected with the external air traveling tube 100 and another side connected with the inside of the bathroom and an air intake part 320 having a side connected with the internal air traveling tube 200 and another side connected with the inside of the bathroom.

11 Claims, 3 Drawing Sheets

(51) Int. Cl.

| | |
|---|---|
| ***F24F 7/08*** | (2006.01) |
| ***E03D 9/05*** | (2006.01) |
| ***F24F 7/10*** | (2006.01) |
| ***F24F 13/10*** | (2006.01) |

(58) Field of Classification Search
USPC ..... 454/230, 238
See application file for complete search history.

(56) References Cited

U.S. PATENT DOCUMENTS 8,808,074 B2 * 8/2014 Kim ..... F24F 13/062 454/254
2006/0117769 A1 * 6/2006 Helt ..... F24F 11/0001 62/161
2008/0242218 A1 * 10/2008 Asano ..... F24F 6/14 454/338
2010/0257669 A1 * 10/2010 Kennedy ..... E03D 9/05 4/348
2014/0099589 A1 * 4/2014 Ploof ..... F24B 5/028 432/21
2014/0349561 A1 * 11/2014 Reiss ..... B64D 13/00 454/76

FOREIGN PATENT DOCUMENTS

| | | |
|---|---|---|
| KR | 10-0602438 | 7/2006 |
| KR | 10-2010-0019640 | 2/2010 |
| KR | 10-2011-0008934 | 1/2011 |

OTHER PUBLICATIONS

English translation of 10-2010-0019640.
English translation of 06-193937.
English translation of 10-0602438.
English translation of 10-2011-0008934.

* cited by examiner

VENTILATION SYSTEM FOR BATHROOM

TECHNICAL FIELD

The present invention relates to a ventilation system for a bathroom, and particularly, to a ventilation system for a bathroom that uses a blower to forcedly discharge air out of the bathroom to refresh the inside the bathroom.

BACKGROUND ART

In general, an apartment building, office building or other human life space has a bathroom(s). In the past, the bathroom was placed at a location isolated from the living space to treat the human excreta. However, a recent trend is towards the bathroom being housed inside the living space as the apartment is favored as a dwelling.

Following such trend, the toilet and basin installed in the bathroom goes on evolving for more sanitation. Further, a change in function of the bathroom from a mere space to treat human waste to a multi-functional room for bathing and makeup led to people staying longer in the bathroom, and the waste treatment space is thus in the trend of being equipped with higher-class facilities.

Meanwhile, an air exhausting facility mostly comes with the bathroom of an apartment house. The air exhausting facility is installed on a ceiling panel inside the bathroom, and a fan is provided on the top or a side of the facility for smooth exhaust. The air exhausting system draws the moisture or odor out of the bathroom.

However, such air exhausting facility simply exhausts air from the bathroom and cannot respond to the satisfaction when the bathroom door remains closed, i.e., in the airtight bathroom.

In other words, although for ventilation an air intake should be the same as the amount of air exhaust, the air intake in the door-closed state fails to reach the amount of air exhaust, thus rendering ventilation difficult.

SUMMARY

Objects

The present invention has been designed to address the above issues, and an object of the present invention is to provide a bathroom ventilation system that has a bi-directional ventilation tube for externally exhausting internal air while simultaneously supplying external air to the bathroom, which enables quick ventilation in the bathroom and which discharges the internal air and odor from the bathroom through an internal air traveling tube, thus preventing odors.

Solution

To achieve the above objects, according to the present invention, a ventilation system for a bathroom comprises: an external air traveling tube 100 provided at an upper side of a ceiling panel of the bathroom and having an air intake fan 150 that takes air in from an outside and moves the taken-in air to an inside of the bathroom; an internal air traveling tube 200 provided at the upper side of the ceiling panel of the bathroom and having an air exhausting fan 250 that draws air from the inside of the bathroom to the outside; and a bi-directional ventilation tube 300 provided at a ceiling of the bathroom, the bi-directional ventilation tube 300 including an air exhausting part 310 having a side connected with the external air traveling tube 100 and another side connected with the inside of the bathroom and an air intake part 320 having a side connected with the internal air traveling tube 200 and another side connected with the inside of the bathroom.

The air intake part 320 is formed to pass through the inside of the air exhausting part 310 to be opened toward the bathroom, and wherein, a guiding plate 330 is provided at the other side of the air intake part 320, which faces the bathroom, along a periphery thereof, the guiding plate 330 projected towards the ceiling of the bathroom.

The ventilation system further comprises an intake adjusting member 400 provided at the other side of the air exhausting part 310, which faces the bathroom, to be movable in a longitudinal direction of the air exhausting part 310 to adjust an air intake.

The intake adjusting member 400 includes:

a fixed part 410 provided at the other side of the air exhausting part 310, the fixed part 410 including a threaded groove part 411 in a middle of the fixed part 410 and an opening 412 formed outside the threaded groove part 411 to connect the inside of the air exhausting part 310 with the inside of the bathroom; and a moving part 420 including a bolt part 421 and a cover 422, the bolt part 421 screw-connected to the nut part 411, the cover 422 rotated to move up and down along the nut part 411 to open and close the opening 412.

The internal air traveling tube 200 includes: a first exhaust pathway 210 provided at the upper side of the ceiling panel of the bathroom and having a side connected with the bi-directional ventilation tube 300, wherein air in the bathroom is sucked through the first exhaust pathway 210; a second exhaust pathway 220 extended along the upper side of the ceiling panel of the bathroom to a side wall of the bathroom and having a side connected with a toilet 10 disposed in the bathroom, wherein air around the toilet 10 is sucked and flows through the second exhaust pathway 220; and a third exhaust pathway 230 provided at the upper side of the ceiling panel of the bathroom and connected with the first exhaust pathway 210 and the second exhaust pathway 220, wherein the third exhaust pathway 230 is connected with the air exhausting fan 250 to exhaust the air inside the bathroom and the air around the toilet 10 to the outside.

The third exhaust pathway 230 includes: a joining section 231 connected with the first exhaust pathway 210 and the second exhaust pathway 220, wherein an internal cross-sectional area of the joining section 231 is larger than a sum of an internal cross-sectional area of the first exhaust pathway 210 and an internal cross-sectional area of the second exhaust pathway 220; a exhausting section 232 having a side connected with the joining section 231 and another side connected with the air exhausting fan 250, wherein an internal cross-sectional area of the exhausting section 232 is larger than a sum of the internal cross-sectional area of the first exhaust pathway 210 and the internal cross-sectional area of the second exhaust pathway 220 and is smaller than the internal cross-sectional area of the joining section 231; an adjusting plate 240 provided in the joining section 231 to, depending on a difference in amount between the air sucked through the first exhaust pathway 210 and the air sucked through the second exhaust pathway 220, shift in a direction towards one, through which a smaller amount of air is sucked, of the first exhaust pathway 210 and the second exhaust pathway 220.

The external air traveling tube 100 includes an air purifying filter 500 to rid the sucked external air of foreign substances and dust.

Effects

The bathroom ventilation system according to the present invention, as described above, provides the following effects.

The intake of air in the bathroom and supply of external air are simultaneously performed through the bi-directional ventilation tube 300. Accordingly, even in the airtight state where the bathroom door stands closed, more loads are prevented from being applied to the air exhausting fan 250, and air circulation is swiftly done. Therefore, the bathroom may remain at a pleasant atmosphere.

Formation of the downwardly-inclined guiding plate 330 along the periphery of the air intake part 320 enables the air discharged from the air exhausting part 310 to flow evenly passing the walls of the bathroom, thus quickly removing the moisture of the walls of the bathroom.

The intake adjusting member 400 is provided at a lower side of the air intake part 320 to move up and down. Accordingly, the user may adjust the amount of air exhausted from the inside of the bathroom and from around the toilet 10, thus allowing for easier use.

The internal air traveling tube 200 includes the second exhaust pathway 220 connected with the toilet 10. Accordingly, the odors around the toilet 10 may be quickly drawn out through the toilet 10 without passing through the inside of the bathroom, thus minimizing germ proliferation. Therefore, the bathroom may remain clean.

The adjusting plate 240 is provided in the third exhaust pathway 230 to be movable toward the first exhaust pathway 210 and the second exhaust pathway 220 depending on air intakes, thus reducing occurrence of a vortex in the joining section 231 while preventing the air sucked through the second exhaust pathway 220 from flowing back to the first exhaust pathway 210.

DESCRIPTION OF EXEMPLARY EMBODIMENTS

Figure 1:
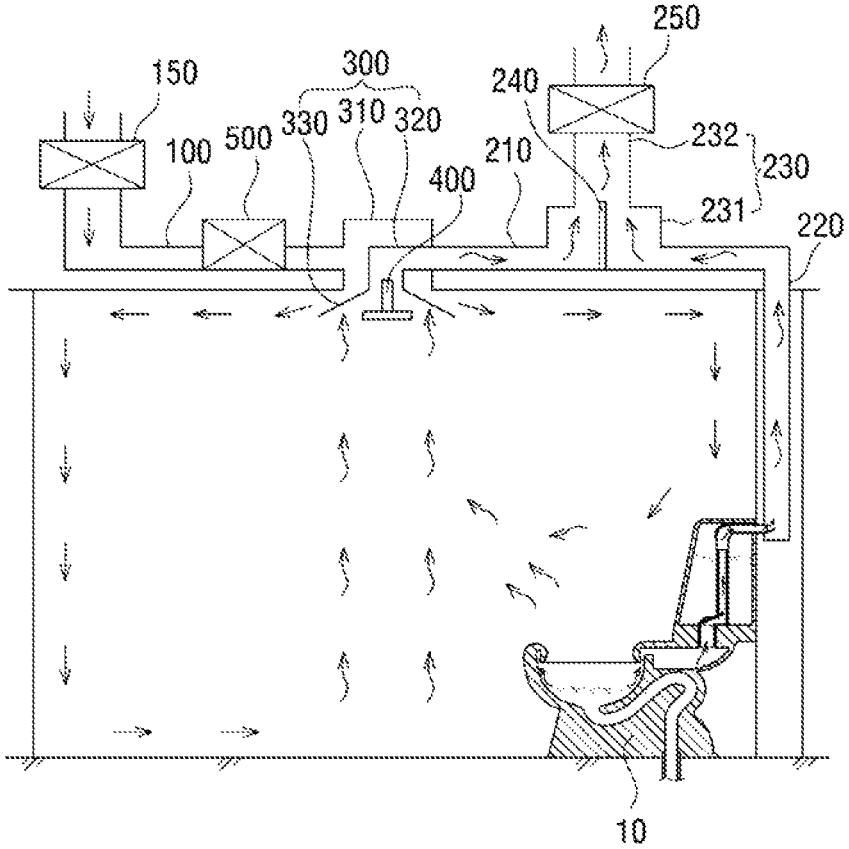
FIG. 1 is a view illustrating a side cross-sectional structure of a bathroom ventilation system according to an embodiment of the present invention.
Figure 2:
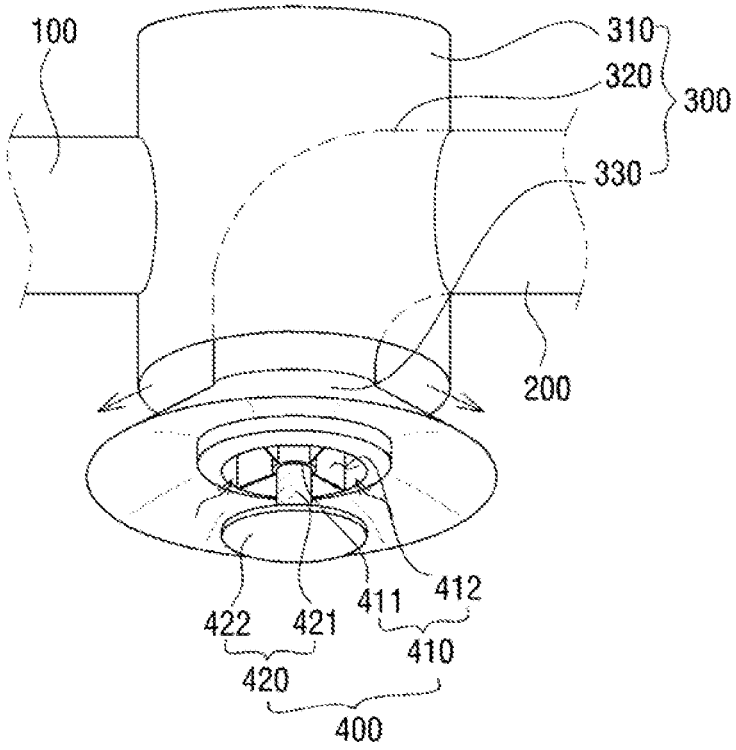
FIG. 2 is a perspective view illustrating a bi-directional ventilation tube 300 of a bathroom ventilation system according to an embodiment of the present invention.
Figure 3:
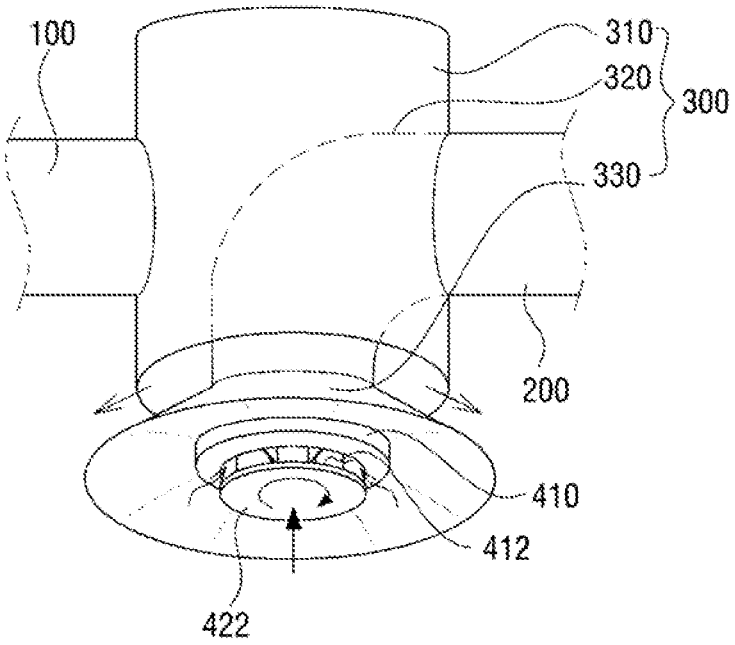
FIG. 3 is a view illustrating an operation state of an intake adjusting member 400 of a bathroom ventilation system according to an embodiment of the present invention.
Figure 4:
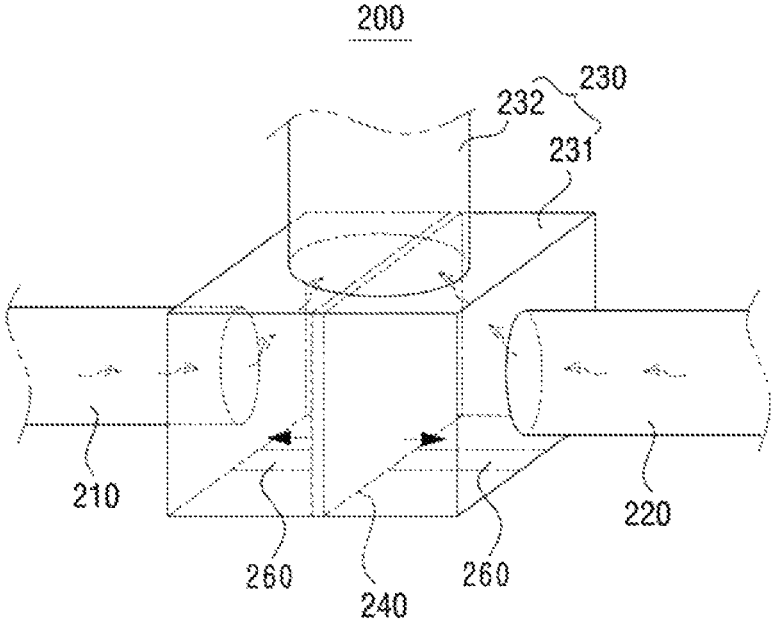
FIG. 4 is a perspective view illustrating a third exhaust pathway 230 of a bathroom ventilation system according to an embodiment of the present invention.
Figure 5:
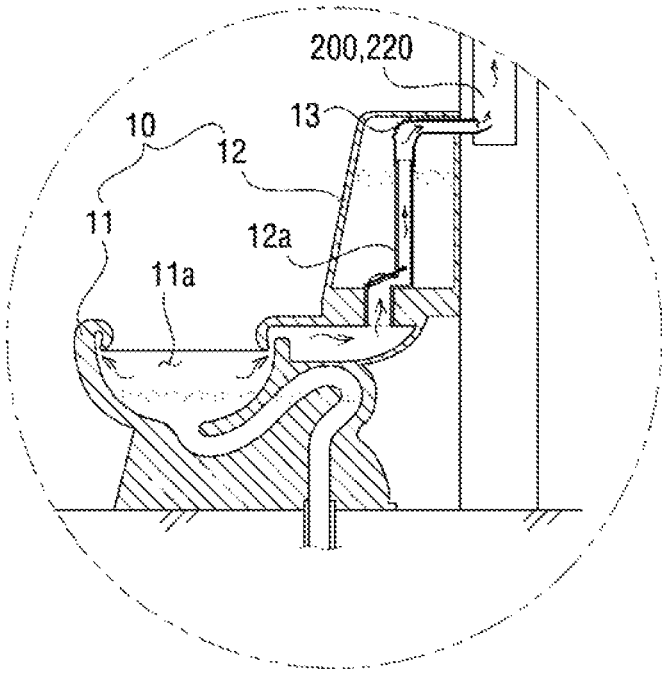
FIG. 5 is an expanded view illustrating a side cross-sectional structure of a second exhaust pathway 220 and a toilet 10 of a bathroom ventilation system according to an embodiment of the present invention.

FIG. 1 is a view illustrating a side cross-sectional structure of a bathroom ventilation system according to an embodiment of the present invention. FIG. 2 is a perspective view illustrating a bi-directional ventilation tube 300 of a bathroom ventilation system according to an embodiment of the present invention. FIG. 3 is a view illustrating an operation state of an intake adjusting member 400 of a bathroom ventilation system according to an embodiment of the present invention. FIG. 4 is a perspective view illustrating a third exhaust pathway 230 of a bathroom ventilation system according to an embodiment of the present invention. FIG. 5 is an expanded view illustrating a side cross-sectional structure of a second exhaust pathway 220 and a toilet 10 of a bathroom ventilation system according to an embodiment of the present invention.

As shown in FIGS. 1 to 5, according to an embodiment of the present invention, the bathroom ventilation system includes an external air traveling tube 100, an internal air traveling tube 200, a bi-directional ventilation tube 300, an intake adjusting member 400, and an air purifying filter 500.

The external air traveling tube 100 is shaped as a hollow tube including a pathway through which air may flow. The external air traveling tube 100 is provided at an upper side of a bathroom ceiling panel. The external air traveling tube 100 is connected with an air intake fan 150 that takes air in from the outside and moves the taken-in air to the inside of the bathroom.

Here, the external air traveling tube 100 is preferably formed of a flexible hose for allowing the external air traveling tube 100 to be freely adjusted in shape and arrangement upon installation. The air intake fan 150 has the same structure as that of a typical blower and detailed description thereof is skipped.

Further, the air purifying filter 500 to be described below is provided in a middle section of the external air traveling tube 100 to remove foreign substances or dust from the air taken in from the outside.

Like the external air traveling tube 100, the internal air traveling tube 200 is shaped as a hollow tube including a pathway through which air may flow. The internal air traveling tube 200 is provided at an upper side of the bathroom ceiling panel. The internal air traveling tube 200 is connected with an air exhausting fan 250 that draws air from the inside of the bathroom to the outside.

Here, the internal air traveling tube 200 is preferably formed of a flexible hose for allowing the external air traveling tube 100 to be freely adjusted in shape and arrangement upon installation. The air exhausting fin 250 has the same structure as that of a typical blower and detailed description thereof is skipped.

Further, the internal air traveling tube 200 sucks the air in the bathroom through the bathroom ceiling and is connected with the toilet 10 installed in the bathroom to suck odors around the toilet 10 and to draw the odors to the outside.

Specifically, the internal air traveling tube 200 includes a first exhaust pathway 210, a second exhaust pathway 220, and a third exhaust pathway 230.

As shown in FIG. 1, the first exhaust pathway 210 is mounted at an upper side of the ceiling panel of the bathroom, and its side, i.e., left side, is connected with the bi-directional ventilation tube 300, and the other side, i.e., right side, is connected with the third exhaust pathway 230 to be described below.

The air in the bathroom is sucked and is rendered to flow the third exhaust pathway 230 through the first exhaust pathway 210.

The second exhaust pathway 220 is extended along the upper side of the ceiling panel of the bathroom and is bent to a right side wall of the bathroom. A side, i.e., a lower end, of the second exhaust pathway 220 is connected with the toilet 10 provided in the bathroom, and another side, i.e., an upper end, thereof is connected with the third exhaust pathway 230 to be described below.

The air around the toilet 10 is sucked and is rendered to flow the third exhaust pathway 230 through the second exhaust pathway 220.

Here, as shown in FIGS. 1 and 5, the toilet 10 is formed of a toilet seat 10. Specifically, the toilet 10 includes a main body 11 having a hollow 11*a* and a water tank 12 including an overflow tube 12*a* communicating with the hollow 11*a*.

A coupling structure 13 is provided in the toilet 10. The coupling structure 13 has an end mounted on an upper end of the overflow tube 12*a* and another end connected with the second exhaust pathway 220.

The coupling structure 13 is shaped as a hollow tube. A middle part of the coupling structure 13 is bent to about 90 degrees. The coupling structure 13 is formed of rubber for easy angling upon installation.

The above configuration enables the odors created in the hollow 11*a* to be sucked to the second exhaust pathway 220 through the overflow tube 12*a* and the coupling structure 13 and to be exhausted to the outside.

Of course, the toilet 10 may also be configured to form a separate pathway communicating with the hollow 11*a* in the main body 11 to be connected with the second exhaust pathway 220 without passing through the overflow tube 12*a*.

As such, the internal air traveling tube 200 includes the second exhaust pathway 220 connected with the toilet 10. Accordingly, the odors around the toilet 10 may be quickly drawn out through the toilet 10 without passing through the inside of the bathroom, thus minimizing germ proliferation. Therefore, the bathroom may remain clean.

Meanwhile, the third exhaust pathway 230 is provided at an upper side of the ceiling panel of the bathroom and is connected with the first exhaust pathway 210 and the second exhaust pathway 220. The air inside the bathroom, together with the air around the toilet 10, is exhausted through the third exhaust pathway 230.

The third exhaust pathway 230, as shown in FIG. 4, is divided into a joining section 231 and an exhausting section 232.

Left and right sides of the joining section 231 are connected with the first exhaust pathway 210 and the second exhaust pathway 220, respectively. The internal cross-sectional area of the joining section 231 is formed to be larger than the sum of the internal cross-sectional area of the first exhaust pathway 210 and the internal cross-sectional area of the second exhaust pathway 220.

The exhausting section 232 is disposed at an upper side of the joining section 231. A side, i.e., a lower side, of the exhausting section 232 is connected with the joining section 231, and another side, i.e., an upper side, thereof is connected with the air exhausting fan 250. The internal cross-sectional area of the exhausting section 232 is formed to be the same as the sum of the internal cross-sectional area of the first exhaust pathway 210 and the internal cross-sectional area of the second exhaust pathway 220.

Meanwhile, the joining section 231 has an adjusting plate 240 that may shift towards the first exhaust pathway 210 and the second exhaust pathway 220.

The adjusting plate 240 is disposed midway between the first exhaust pathway 210 and the second exhaust pathway 220, i.e., at a middle of the exhausting section 232. The adjusting plate 240 is shaped as a rectangular plate.

The adjusting plate 240 prevents a vortex that may occur when the air sucked through the first exhaust pathway 210 and the air sucked through the second exhaust pathway 220 meet each other in the joining section 231 and allows the air to be smoothly drawn out.

Further, the adjusting plate 240 shifts depending on a difference in amount between the air sucked through the first exhaust pathway 210 and the air sucked through the second exhaust pathway 220. For example, the adjusting plate 240 moves in a direction in which a smaller amount of air is sucked.

The amount of air sucked through the first exhaust pathway 210 may be varied by the intake adjusting member 400 to be described below. In this case, if the air intake through the first exhaust pathway 210 is smaller than the air intake through the second exhaust pathway 220, the adjusting plate 240 shifts toward the first exhaust pathway 210, and the inlet of the third exhaust pathway 230 communicating with the first exhaust pathway 210 is narrowed, and the inlet of the third exhaust pathway 230 communicating with the second exhaust pathway 220 is broadened.

In case the adjusting plate 240 remains at a fixed position, even when the inlet of the intake adjusting member 400, through which air is taken in is narrowed, the inlet of the third exhaust pathway 230 connected with the first exhaust pathway 210 remains the same area. Thus, the air pressure in the first exhaust pathway 210 is decreased while the air pressure in the second exhaust pathway 220 is increased. Hence, the air around the toilet 10, which is sucked to the exhaust pathways, is rendered to flow back to the first exhaust pathway 210. Accordingly, the adjusting plate 240 is preferably provided to be movable in order to keep the air pressure in the first exhaust pathway 210 equal to the air pressure in the second exhaust pathway 220.

As such, the adjusting plate 240 is provided in the third exhaust pathway 230 to be movable toward the first exhaust pathway 210 and the second exhaust pathway 220 depending on air intakes, thus reducing occurrence of a vortex in the joining section 231 while preventing the air sucked through the second exhaust pathway 220 from flowing back to the first exhaust pathway 210.

Here, in order to enable such shift of the adjusting plate 240, for example, a guide rail(s) 260 may be formed on an upper surface and/or lower surface of the third exhaust pathway 230, and a guide block(s) or roller(s) may be formed on an upper surface and/or lower surface of the adjusting plate 240 to be slid on the guide rails 260.

Meanwhile, as shown in FIGS. 1 to 3, the bi-directional ventilation tube 300 is installed at the center of the bathroom ceiling, and the external air traveling tube 100 and the internal air traveling tube 200 each are connected to the inside of the bathroom.

Specifically, the bi-directional ventilation tube 300 includes an air exhausting part 310 and an air intake part 320.

The air exhausting part 310 has a lower end opened and is shaped as a cylinder. A side part of the air exhausting part 310 is connected with the external air traveling tube 100, and the lower end thereof is connected with the inside of the bathroom.

Further, the inner diameter of the air exhausting part 310 is formed to be about twice as large as the inner diameter of the external air traveling tube 100.

The air intake part 320 is of a hollow shape having ends opened. The air intake part 320 is bent at about 90 degrees to be shaped as the letter "L." A side, i.e., a right side, of the air intake part 320 is connected with the internal air traveling tube 200, and another side, i.e., a lower side, thereof is connected with the inside of the bathroom.

Further, a guiding plate 330 is provided at a lower side of the air intake part 320 along the periphery thereof. The guiding plate 330 is projected towards the bathroom ceiling.

The guiding plate 330 is formed of an inclined plate of to truncated cone shape inclined downwards. The guiding plate 330 is disposed at a lower part of the outlet of the air exhausting part 310. The guiding plate 330 is formed to be larger in diameter than the air exhausting part 310.

The guiding plate 330 guides the air discharged from the air exhausting part 310 to be widely spread to and the ceiling wall of the bathroom.

As such, formation of the downwardly-inclined guiding plate 330 along the periphery of the air intake part 320 enables the air discharged from the air exhausting part 310 to flow evenly passing the walls of the bathroom, thus quickly removing the moisture of the walls of the bathroom.

Meanwhile, the intake adjusting member 400 is provided at a bathroom-facing side of the air intake part 320. The intake adjusting member 400 moves up and down to adjust the air intake of the air intake part 320.

More specifically, the intake adjusting member 400, as shown in FIGS. 2 and 3, includes a fixed part 410 and a moving part 420.

The fixed part 410 is shaped as a cylinder and is fixed to the other side of the air intake part 320. The fixed part 410 includes a nut part 411 a threaded inner circumferential surface in the middle of the fixed part 410 and an opening 412 formed through outside the nut part 411 to connect the inside of the air intake part 320 with the inside of the bathroom.

The moving part 420 includes a bolt part 421 and a cover 422. The bolt part 421 is shaped as a long cylinder and has a threaded outer circumferential surface, like a bolt. The cover 422 is coupled with the nut part 411 and rotates to move up and down along the nut part 411.

The cover 422 is formed at a lower end of the bolt part 421. The cover 422 is shaped as a disc. The diameter of the cover 422 is equal or larger than the diameter of the opening 412.

The cover 422, as shown in FIGS. 2 and 3, adjusts the degree of opening and closing of the opening 412 as the bolt part 421 moves up and down along the nut part 411.

Such intake adjusting member 400, in case the cover 422 ascends to narrow the opening 412, reduces the air intake from the inside of the bathroom while increasing the air intake from around the toilet 10 through the second exhaust pathway 220.

As such, the intake adjusting member 400 is provided at a lower side of the air intake part 320 to move up and down. Accordingly, the user may adjust the amount of air exhausted from the inside of the bathroom and from around the toilet 10, thus allowing for easier use.

Meanwhile, the external air traveling tube 100 includes an air purifying filter 500 to rid the sucked external air of foreign substances and dust.

The air purifying filter 500 may be a honeycomb filter that may be semi-permanently used, and in some cases, various typical filters may be employed as the air purifying filter 500.

In the bathroom ventilation system configured above according to the present invention, the intake of air in the bathroom and supply of external air are simultaneously performed through the bi-directional ventilation tube 300. Accordingly, even in the airtight state where the bathroom door stands closed, more loads are prevented from being applied to the air exhausting fan 250, and air circulation is swiftly done. Therefore, the bathroom may remain at a pleasant atmosphere.

It should be understood that the present invention is not limited to the above described embodiments, and various changes in form and details may be made thereto by one of ordinary skill in the art without departing from the spirit and scope of the present invention defined in the following claims, and such also should belong to the scope of the present invention.

The invention claimed is:

1. A ventilation system for a bathroom, comprising:

an external air traveling tube provided at an upper side of a ceiling panel of the bathroom and having an external air intake fan that takes air in from an outside and moves the taken-in air to an inside of the bathroom;

an internal air traveling tube provided at the upper side of the ceiling panel of the bathroom and having an internal air exhausting fan that draws air from the inside of the bathroom to the outside, a bi-directional ventilation tube provided at a ceiling of the bathroom, the bi-directional ventilation tube including an external air exhausting part having a side connected with the external air traveling tube and another side connected with the inside of the bathroom and an internal air intake part formed to pass through an inside of the external air exhausting part and having a side connected with the internal air traveling tube and another side connected with the inside of the bathroom, wherein the air flows from an outside of the bathroom to the inside of the bathroom through the external air exhausting part, and the air flows from the inside of the bathroom to the outside of the bathroom through the internal air intake part, and an internal air intake adjusting member provided at the other side of the external air exhausting part, which faces the bathroom, to be movable in a longitudinal direction of the external air exhausting part to adjust an internal air intake, wherein the internal air traveling tube includes: a first exhaust pathway provided at the upper side of the ceiling panel of the bathroom and having a side connected with the bi-directional ventilation tube, wherein air in the bathroom is sucked through the first exhaust pathway; a second exhaust pathway extended along the upper side of the ceiling panel of the bathroom to a side wall of the bathroom and having a side connected with a toilet disposed in the bathroom, wherein air around the toilet is sucked and flows through the second exhaust pathway; and a third exhaust pathway provided at the upper side of the ceiling panel of the bathroom and connected with the first exhaust pathway and the second exhaust pathway, wherein the third exhaust pathway is connected with the internal air exhausting fan to exhaust the air inside the bathroom and the air around the toilet to the outside, and wherein the third exhaust pathway includes: a joining section connected with the first exhaust pathway and the second exhaust pathway, wherein an internal cross-sectional area of the joining section is larger than a sum of an internal cross-sectional area of the first exhaust pathway and an internal cross-sectional area of the second exhaust pathway; an internal exhausting section having a side connected with the joining section and another side connected with the internal air exhausting fan, wherein an internal cross-sectional area of the internal exhausting section is larger than a sum of the internal cross-sectional area of the first exhaust pathway and the internal cross-sectional area of the second exhaust pathway and is smaller than the internal cross-sectional area of the joining section; and an adjusting plate provided in the joining section to, depending on a difference in amount between the air sucked through the first exhaust pathway and the air sucked through the second exhaust pathway, shift in a direction towards one, through which a smaller amount of air is sucked, of the first exhaust pathway and the second exhaust pathway.

2. The ventilation system of claim 1, wherein the internal air intake part is opened toward the bathroom, and wherein, a guiding plate is provided at the other side of the internal air intake part, which faces the bathroom, along a periphery thereof, the guiding plate projected towards the ceiling of the bathroom.

3. The ventilation system of claim 1, wherein the internal air intake adjusting member includes:

a fixed part provided at the other side of the external air exhausting part, the fixed part including a nut part in a middle of the fixed part and an opening formed outside the nut part to connect the inside of the external air exhausting part with the inside of the bathroom; and a moving part including a bolt part and a cover, the bolt part screw-connected to the nut part, the cover rotated to move up and down along the nut part to open and close the opening.

4. The ventilation system of claim 1, wherein the external air traveling tube includes an air purifying filter to rid the sucked external air of foreign substances and dust.

5. The ventilation system of claim 1, wherein the toilet comprises:

a water tank;

a hollow; and an overflow tube disposed inside the water tank, wherein an end of the overflow tube is connected to the hollow, and another end of the overflow tube is connected to the second exhaust pathway.

6. A ventilation system, comprising:

an external air traveling tube provided at an upper side of a ceiling panel of the bathroom and having an external air intake air that takes air in from an outside and moves the taken-in air to an inside of the bathroom;

an internal air traveling tube provided at the upper side of the ceiling panel of the bathroom and having an internal air exhausting fan that draws air from the inside of the bathroom to the outside;

a bi-directional ventilation tube provided at a ceiling of the bathroom, the bi-directional ventilation tube including external air exhausting part having a side connected with the external air traveling tube and another side connected with the inside of the bathroom and an internal air intake part formed to pass through an inside of the external air exhausting part and having a side connected with the internal air traveling tube and another side connected with the inside of the bathroom, wherein the air flows from an outside of the bathroom to the inside of the bathroom through the external air exhausting part, and the air flows from the inside of the bathroom to the outside of the bathroom through the internal air intake part, and an internal air intake adjusting member provided at the other side of the external air exhausting part, which faces the bathroom, to be movable in a longitudinal direction of the external air exhausting part to adjust an internal air intake, wherein the internal air traveling tube includes: a first exhaust pathway provided at the upper side of the ceiling panel of the bathroom and having a side connected with the bi-directional ventilation tube, wherein air in the bathroom is sucked through the first exhaust pathway; a second exhaust pathway extended along the upper side of the ceiling panel of the bathroom to a side wall of the bathroom and having a side connected with a toilet disposed in the bathroom, wherein air around the toilet is sucked and flows through the second exhaust pathway; and the third exhaust pathway provided at the upper side of the ceiling panel of the bathroom and connected with the first exhaust pathway and the second exhaust pathway, wherein the third exhaust pathway is connected with the internal air exhausting fan to exhaust the air inside the bathroom and the air around the toilet to the outside, wherein the third exhaust pathway includes: a joining section connected with the first exhaust pathway and the second exhaust pathway, wherein an internal cross-sectional area of the joining section is larger than a sum of an internal cross-sectional area of the first exhaust pathway and an internal cross-sectional area of the second exhaust pathway; an internal exhausting section having a side connected with the joining section and another side connected with the internal air exhausting fan, wherein an internal cross-sectional area of the internal exhausting section is larger than a sum of the internal cross-sectional area of the first exhaust pathway and the internal cross-sectional area of the second exhaust pathway and is smaller than the internal cross-sectional area of the joining section; and an adjusting plate provided in the joining section to, depending on a difference in amount between the air sucked through the first exhaust pathway and the air sucked through the second exhaust pathway, shift in a direction towards one, through which a smaller amount of air is sucked, of the first exhaust pathway and the second exhaust pathway, and wherein the adjusting plate is shifted with guide rails formed on both an upper surface and/or lower surface of the third exhaust pathway.

7. A ventilation system, comprising:

an external air exhausting part shaped as a hollow tube;

an internal air intake part formed to pass through an inside of the air exhausting part and shaped as a hollow tube; and an intake adjusting member provided at a first end of the internal air intake part which faces a bathroom, to be movable in a longitudinal direction of the internal air intake part to adjust an air intake, wherein a lower end of the external air exhausting part is opened toward a bathroom, a first side of the external air exhausting part is connected to an external air traveling tube, and a second side of the external air exhausting part has a hole to be coupled with an internal air traveling tube, wherein a second end of the internal air intake part is connected to the internal air traveling tube, wherein the internal air traveling tube includes: a first exhaust pathway provided at the upper side of the ceiling panel of the bathroom and having a side connected with the internal air traveling tube, wherein air in the bathroom is sucked through the first exhaust pathway; a second exhaust pathway extended along the upper side of the ceiling panel of the bathroom to a side wall of the bathroom and having a side connected with a toilet disposed in the bathroom, wherein air around the toilet is sucked and flows through the second exhaust pathway; and the third exhaust pathway provided at the upper side of the ceiling panel of the bathroom and connected with the first exhaust pathway and the second exhaust pathway, wherein the third exhaust pathway is connected with the internal air exhausting fan to exhaust the air inside the bathroom and the air around the toilet to the outside, wherein the third exhaust pathway includes: a joining section connected with the first exhaust pathway and the second exhaust pathway, wherein an internal cross-sectional area of the joining section is larger than a sum of an internal cross-sectional area of the first exhaust pathway and an internal cross-sectional area of the second exhaust pathway; an internal exhausting section having a side connected with the joining section and another side connected with the internal air exhausting fan, wherein an internal cross-sectional area of the internal exhausting section is larger than a sum of the internal cross-sectional area of the first exhaust pathway and the internal cross-sectional area of the second exhaust pathway and is smaller than the internal cross-sectional area of the joining section; and an adjusting plate provided in the joining section to, depending on a difference in amount between the air sucked through the first exhaust pathway and the air sucked through the second exhaust pathway, shift in a direction towards one, through which a smaller amount of air is sucked, of the first exhaust pathway and the second exhaust pathway, and wherein the adjusting plate is shifted with guide rails formed on both an upper surface and/or lower surface of the third exhaust pathway.

8. The ventilation system of claim 7, further comprising an external air intake fan connected to the external air traveling tube.

9. The ventilation system of claim 7, further comprising an internal air exhausting fan connected to the internal air traveling tube.

10. The ventilation system of claim 7, further comprising a guiding plate provided at the first end of the internal air intake part along a periphery thereof, wherein the guiding plate is projected towards the ceiling of the bathroom.

11. The ventilation system of claim 7, wherein the external air traveling tube includes an air purifying filter.

* * * * *